United States Patent [19]

Coker et al.

[11] Patent Number: 4,561,945

[45] Date of Patent: Dec. 31, 1985

[54] ELECTROLYSIS OF ALKALI METAL SALTS WITH HYDROGEN DEPOLARIZED ANODES

[75] Inventors: Thomas G. Coker, Lexington; Anthony B. La Conti, Lynnfield, both of Mass.

[73] Assignee: United Technologies Corporation, Hartford, Conn.

[21] Appl. No.: 635,976

[22] Filed: Jul. 30, 1984

[51] Int. Cl.[4] ..... C25B 1/16; C25B 1/22; C25B 1/02

[52] U.S. Cl. ..... 204/98; 204/103; 204/104; 204/129

[58] Field of Search ..... 204/98, 128, 129, 103, 204/104, 283, 284

[56] References Cited

U.S. PATENT DOCUMENTS

| | | | |
|---|---|---|---|
| 3,523,755 | 8/1970 | McRae | 204/98 |
| 3,523,880 | 8/1970 | Parsi | 204/104 |
| 3,801,698 | 4/1974 | Lowrance et al. | 204/98 |
| 3,963,592 | 6/1976 | Lindström | 204/103 |
| 4,203,813 | 5/1980 | Grantham | 204/103 |

*Primary Examiner*—Andrew H. Metz
*Assistant Examiner*—Terryence Chapman
*Attorney, Agent, or Firm*—Alan C. Cohen; I. David Blumenfeld

[57] ABSTRACT

A process for producing sulfuric acid and caustic soda by the electrolysis of an alkali metal sulfate in a membrane cell having a hydrogen depolarized anode. Hydrogen gas in the anode chamber is oxidized to produce hydrogen cations which combine with the sulfate anions from the aqueous alkali metal sulfate solution to produce sulfuric acid. Alkali metal ions are transported across the membrane to the cathode to produce caustic and gaseous hydrogen. By oxidizing hydrogen at the anode, the cell voltage for the electrolysis of the alkali metal sulfate is substantially reduced.

13 Claims, 3 Drawing Figures

ELECTROLYSIS OF ALKALI METAL SALTS WITH HYDROGEN DEPOLARIZED ANODES

This invention relates to a process for electrolyizing an alkali metal salt to produce caustic and acid, more particularly it relates to a highly efficient process for electrolyzing sodium sulfate to produce caustic and sulfuric acid.

Large quantities of sodium sulfate ($Na_2SO_4$) are produced annually as a byproduct of an industrial process for the production of rayon. While there are uses for sodium sulfate as an industrial feedstock, as for example the production of detergents, substantial quantities of sodium sulfate must be disposed of in an environmentally acceptable yet economically feasible manner. There are significant potential advantages, to the rayon industry in particular, in a process for recycling sodium sulfate to produce sodium hydroxide since sodium hydroxide itself is one of the raw materials used in the manufacture of rayon. The economic value of such a recycling process is measured not only in terms of the cost of producing the caustic from the sodium sulfate but also in terms of the avoidance of disposal cost of the sulfate.

Applicant has found an effective, economical process for converting alkali metal salts such as sodium sulfate, as well as other sodium salts, including sodium silicate, sodium citrate, sodium phosphate, etc., into useful industrial feedstocks as silicilic acid, citric acid, phosphoric acid, etc. The process involves introduction of gaseous hydrogen at the anode of a membrane electrolysis cell. The gaseous hydrogen is oxidized at the anode to produce hydrogen ions. The hydrogen ions combine with anions from the alkali metal salts such as sulfate anions in the case of sodium sulfate, to produce an acid. The sodium ions are transported across the membrane to the cathode. The products of the cathode reaction are sodium hydroxide and hydrogen gas. While sodium salts are the principal salts used as feedstocks in the process, the invention is by no means so limited. Potassium and other alkali metal salts can also be utilized, yielding the corresponding hydroxide (KOH) and acid. Other weak alkaline salt solutions such as diluted sodium hyroxide (10–12%)/salt solutions, sodium carbonate, sodium bicarbonate can be efficiently converted to a high purity concentrated (28–50%) sodium hydroxide using this process. The gaseous hydrogen is oxidized at the anode to produce hydrogen ions. The hydrogen ions combine with the hydroxide ions of the weak alkaline salt solution to form water. The sodium ions are transported across the membrane to the cathode. The products of the cathode reactions are a high purity concentrated sodium hydroxide and hydrogen.

Previously known processes for the electrolysis of aqueous sodium sulfate involved electrolysis of water at the anode to produce gaseous oxygen and hydrogen ions which combine with the sulfate anion to form sulfuric acid. The cell voltages for these prior art processes were, however, quite high.

By virtue of hydrogen depolarization of the anode, the anode voltage with the present process is around 0 volts compared to the 1.23 volts for electrolysis of water. Furthermore, the $H_2/H^+$ reaction is much more reversible than the $H_2O/H^+$, $O_2$ reaction so that the anode overvoltage is much lower than it is for the prior art process. The cell voltage for the process involving hydrogen depolarization of the anode is reduced at least by the theoretical voltage difference of 1.23 volts between the $H_2/H^+$ and $H_2O/H^+$, $O_2$ reactions.

It is, therefore, a principal objective of the invention to provide electrochemical process for the production of caustic from an alkali metal salt.

Another objective of the invention is to provide a process for producing caustic from an alkali metal salt which is highly economical.

Still another objective of the invention is to provide an economical process for electrolyzing sodium sulfate to produce caustic and acid at much lower costs than hitherto possible.

Still another objective is to provide a process for electrolyzing alkali metals salts to produce caustic by use of a hydrogen depolarized anode.

Still another objective of the invention is to electrolyze alkali metal sulfate to produce caustic with a hydrogen depolarized anode.

Other objectives and advantages of the invention will become apparent as the description thereof proceeds.

The objectives and advantages of the instant invention are realized in a membrane cell process for the electrolysis of sodium salts such as sodium sulfate, etc. in which gaseous hydrogen is introduced into the anode chamber to produce hydrogen ions combined with sulfate or other anions to produce an acid byproduct whereas the sodium ions are transported across the membrane to the cathode to produce sodium hydroxide and gaseous hydrogen at the anode. This reduces the overall cell voltage and hence the cost of manufacture of the sodium hydroxide. The hydrogen generated at the cathode is preferably used as a gaseous hydrogen source to depolarize the anode. It is also evident that hydrogen containing feeds derived from methanol reforming, ammonia cracking, etc. could be used to depolarize the anode.

The novel features which are believed to be characteristic of this invention are set forth with particularity in the appended claims. The invention itself, however, both as to its construction and method of operation together with further objectives and advantages thereof can best be understood by reference to the following description taken in connection with the accompanying drawings in which:

FIG. 1 is a schematic illustration of a membrane cell for electrolyzing sodium salts such as alkali metal salts; particularly sodium sulfate, NaCl, $Na_3PO_4$, $NaNO_3$, $Na_2SiO_3$ to produce caustic and acid such as $H_2SO_4$, HCl, $H_3PO_4$, $HNO_3$, $H_2SiO_3$ in an electrolyzer having a hydrogen depolarized anode.

Figure 1:
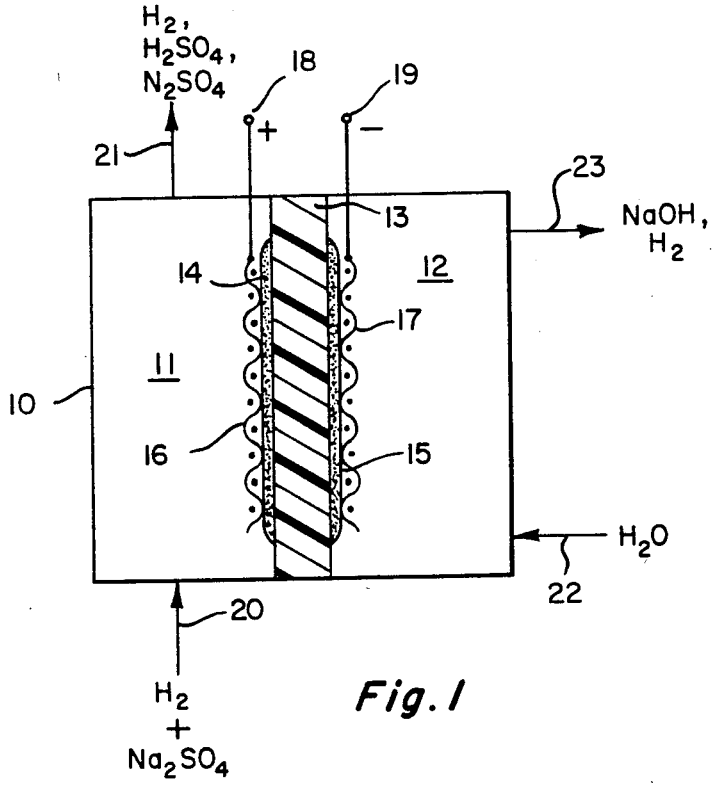
FIG. 1 is a sectional view of a hydrogen depolarized membrane cell for the electrolysis of sodium sulfate.

The cell includes a housing 10 which is divided by a gas and liquid impervious permselective membrane means 13 into anode and cathode chambers 11 and 12. Anode and cathode electrodes 14 and 15 are in intimate contact with opposite sides of membrane 13, and, in the preferred form, are bonded directly to the surface of the membrane to form unitary electrode-membrane structures. The anode and cathode electrodes, as will be described in detail later, are porous, and gas permeable, and comprise bonded aggregates of electrocatalytic and polymeric particles.

Anode and cathode current collectors 16 and 17 are positioned adjacent to and in physical current conductive contact with the surface of the anode and cathode electrodes. The collectors are connected through suitable leads to the positive and negative terminals of an electrical power source to supply current to the electrodes for electrolysis of the anolyte and catholyte.

Although the preferred mode of intimate contact with the membrane is by bonding an aggregate of catalytic particles directly to the surface of the membrane, the invention is not limited thereto as an electrode element may simply by pressed against the surface of the membrane. By maintaining the electrodes in intimate contact with the membrane IR losses between the electrode and the membranes are minimized.

Figure 2:
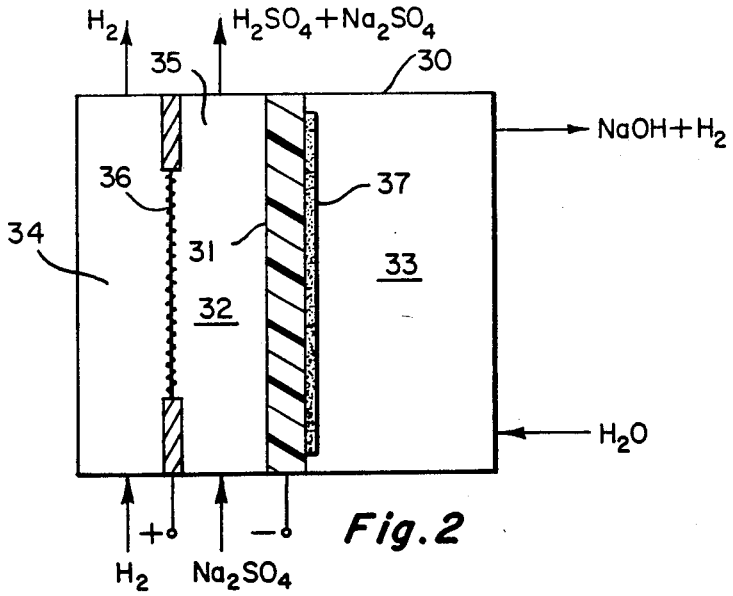
FIG. 2 illustrates an alternative embodiment of the electrolysis cell of FIG. 1.

The invention, however, is not limited to electrodes in intimate contact for, as is shown in FIG. 2, and as will be discussed later, an electrode may be positioned away from the membrane as long as the feedstock is conductive. In the case of sodium sulfate, etc. the conductive nature of the feedstocks permits transfer of the sodium ions to the membrane and across the membrane to the cathode.

Where the electrodes are the form of bonded aggregates of electrocatalytic and polymeric particles, the electrochemically active catalytic particles are preferably particles of a platinum group metal or dispersions of platinum group metals or oxides thereof and may include oxides of valve metals as well as electroconductive extenders such as graphite. By utilizing a bonded aggregate of catalytic and polymeric particles which are bonded to the surface of the membrane, the electrode is dispersed over major portion of the membrane surface and many individual particles contact the membrane at a plurality of points. Bonding of the electrode is readily achieved by means of the application of heat and pressure. The preferred form of the polymeric particles are polytetrafluorethylene particles.

An aqueous solution of an alkali metal such as sodium sulfate is introduced into chamber 11 through inlet conduit 20 and a gaseous hydrogen stream is introduced into the chamber into contact with the anode electrode. An aqueous catholyte such as distilled water or dilute caustic is introduced to the cathode compartment through an inlet conduit 22. Sulfuric acid, spent alkali metal sulfate, and excess hydrogen gas is removed from the anode chamber via outlet conduit 21. Hydrogen, caustic, and excess water is removed from the cathode chamber via outlet conduit 23. The hydrogen gas from the cathode chamber is separated from the caustic, and may be recirculated to the anode chamber.

The anode chamber housing is fabricated of a material which is resistant to the sulfuric acid formed in the chamber and to the feedstock itself. Tantalum or graphite are materials which are suitable for use as anode housing materials. The cathode housing may be fabricated of materials which are resistant to caustic. Nickel and stainless steel are examples of such materials. The anode current collector must be of a material which is corrosion resistant, does not form a non-conductive oxide film under anodic conditions, and provides good current conduction. Examples of such materials are gold, platinum, graphite, niobium, titantium-palladium and titanium-nickel-molybdenum alloys available from the Timet Corporation. Nickel and stainless steel screens or any material resistant to caustic may be utilized as the current collecting elements contacting the cathode.

The permselective membranes are hydrolyzed copolymers or polytetrafluorethylene and perfluorosulfonylethoxyvinylether. The functional groups attached to the membrane backbone may be sulfonic acids or salts. Such membranes are readily available from a variety of sources including those available from the DuPont Company under its trade designation Nafion. Nafion membranes with varying equivalent weights and varying hydroxyl rejection characteristics are available. One Nafion membrane having high hydroxyl ion rejection characteristics is a laminate 1100/1500 equivalent weight membrane available under the trade designation Nafion 315. Alternatively, membranes with carboxylate functional groups, i.e., carboxylic acid or salts, may also be used as these have excellent rejection characteristics for hydroxyl ions. However, inasmuch as carboxylics are not as readily dissociable, their resistance is high, and it may be desirable to use hybrid membranes in which a thin layer having carboxylic acid or salt functional groups is provided on the cathode side of the membrane whereas the remaining portion of the membrane has sulfonate functional groups.

The aqueous sodium sulfate solution introduced into the anode chamber along with the gaseous hydrogen stream result in oxidation of the gaseous hydrogen to form hydrogen ions ($H^+$). The hydrogen cations combine with the $SO_4^=$ anions from the sodium sulfate solution to form sulfuric acid in the anode chamber. The sodium cations from the anolyte solution are transported across the cation transporting membrane to the cathode. Water is decomposed at the cathode to form hydroxyl hydrogen ions. The hydrogen ions are discharged at the electrode as gaseous hydrogen and the sodium ions transported across the membrane combine with the hydroxyl ions to form caustic. The gaseous hydrogen and concentrated caustic produced at the cathode are them discharged from the electrolyzer and separated for utilization.

FIG. 2 shows an alternative embodiment of the membrane cell for electrolyzing an alkaline metal salt such as sodium sulfate with a hydrogen depolarized anode. In FIG. 2, the anode electrode at which gaseous hydrogen is oxidized to form hydrogen ions, is a free standing electrode spaced from the permselective membrane. Thus the cell of FIG. 2 illustrates shows a housing 30, which as pointed out previously, may be of a metal such as tantalum on the anode side, and nickel or stainless steel or other caustic resistant material on the cathode side. Housing 30 is separated by a permselective membrane 31 into anode and cathode chambers 32 and 33. Anode chamber 32 is separated into a hydrogen chamber 34 and an anolyte chamber 35. A freestanding anode electrode 36 shown in the form of a microporous mass is connected to the positive terminal of a power source. Porous electrode 36 may be fabricated of platinum group metal or metal oxides deposited on a core material or may be the platinum group metal or metal oxide particles themselves. The porosity of the electrode is preferably controlled both as to pore size and pore size distribution in such a manner that the gaseous hydrogen readily permeates therethrough, whereas the aqueous sodium sulfate is essentially blocked from hydrogen chamber 34. The cathode electrode is bonded directly to the opposite side of membrane 31. The cathode is connected to the negative terminal of a power source through a nickel screen mesh material.

Gaseous hydrogen is introduced into the hydrogen chamber at the back of electrode 36. An aqueous solution of an alkali metal salt such as sodium sulfate is introduced into the space between electrode 36 and membrane 31. The hydrogen permeates through electrode 36 and is oxidized to produce hydrogen ions. The hydrogen ions pass into the solution contained between the electrode and membrane 31 and combine with the sulfate anions to form sulfuric acid which is removed from chamber 35 along with any excess sodium sulfate. The alkali metal ions from the aqueous solution in chamber 35 are transported across membrane 31 to cathode electrode 37. Water or a dilute aqueous solution of sodium hydroxide is introduced into the cathode chamber and undergoes a reaction to form hydroxyl ions and gaseous hydrogen. Hydroxyl ions combine with sodium cations to produce caustic which is removed along with any excess gaseous hydrogen and any excess water.

A process in which hydrogen is oxidized at a free standing electrode spaced from the membrane has the advantage that the hydrogen gas can be flowed over the surface of the electrode away from the aqueous anolyte sodium salt. This makes access to the electrode much simpler than is otherwise the case. In addition, the hydrogen ions are principally located away from the permselective membrane so that the ratio of $Na^+$ to $H^+$ ions at the membrane/sodium sulfate interface is very high resulting in favorable transport of the sodium ion across the membrane.

Figure 3:
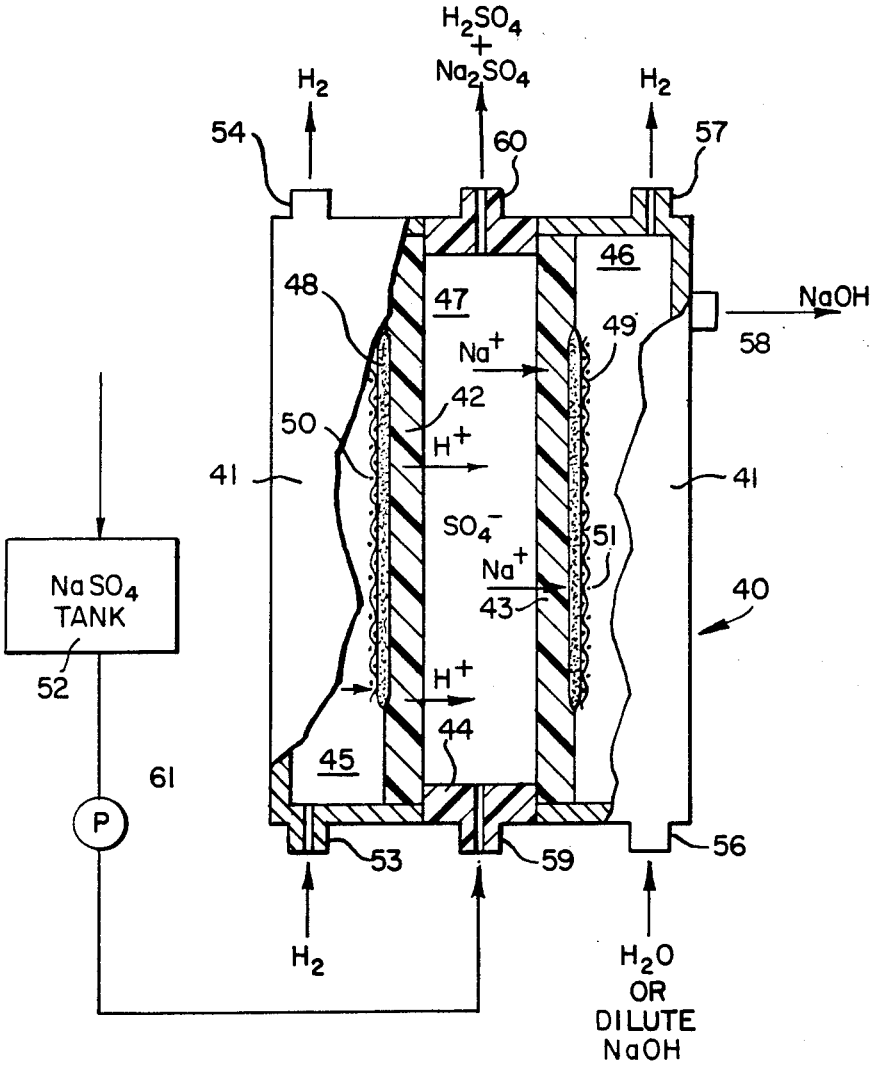
FIG. 3 shows a three-compartment, hydrogen depolarized, sodium sulfate, electrolysis cell.

FIG. 3 illustrates the preferred mode of the invention in which a sodium salt, such as sodium sulfate, is electrolyzed to produce sulfuric acid and caustic in a three-chamber cell. Gaseous hydrogen is passed through the anode chamber. The aqueous solution of sodium sulfate passes though the central or buffer chamber and caustic is formed in the cathode chamber. Cell 40 includes a housing 41 which is divided by gas and liquid impervious permselective membranes 42 and 43 and a non-conductive frame 44 into an anode chamber 45, a cathode chamber 46, and a central or buffer chamber 47. Anode and cathode electrodes 48 and 49, in the form of bonded aggregates of electric catalytic and polymeric particles, are maintained in intimate contact with the surfaces of membranes 42 and 43 facing away from the central chamber. The intimate contact, as illustrated in FIG. 3, is by bonding the aggregate directly to the surface of the membrane to form unitary membrane and electrode structures. Positioned adjacent to and in physical, current exchanging contact with the anode and cathode electrodes are anode and cathode current collectors 50 and 51 which are connected through suitable conductors to the positive and negative terminals of a voltage source to supply current to the electrodes for oxidation of a gaseous hydrogen stream and in the anode chamber and the dissociation of water in the cathode chamber to form hydroxyl ions and gaseous hydrogen.

The anode and cathode electrode aggregates, are porous and gas permeable and, as pointed out before, an aggregate of electrocatalytic and polymeric particles. Catalytic particles are preferably particles of platinum group metals or platinum group metal oxides or dispersions of reduced metal particles which may include reduced oxides and valve metals as well as electroconductive extenders such as graphite. Polymeric particles are preferably fluorocarbon particles such as polytetrafluoroethylene. The bonded aggregate is itself bonded to the surface of the membrane by the application of heat and pressure so that the electrode is dispersed over a major part of the membrane. As a result a great number of individual particles contact the membrane at a plurality of points.

An aqueous solution of an alkali metal salt, preferably sodium sulfate, is fed to central chamber 47 through conduit 59 from a holding tank 52. A pump 61 may be interposed between the tank and the central chamber to pump the aqueous sodium sulfate at a pressure higher than pressures in the anolyte and catholyte chambers so that the membranes are forced outward and into good contact with the current conductor screens 49 and 50. Excess hydrogen gas is removed from the anode chamber over conduit 54 and hydrogen and caustic are removed from the cathode chamber through exit conduits 57 and 58 respectively.

The hydrogen ions produced by the oxidation of the gaseous hydrogen at the anode electrode 48 are transported through anode membrane 42 into chamber 47 where they combine with the sulfate anions to produce sulfuric acid. The sodium cations in the central chamber are transported across the cathode membrane 43 to the cathode electrode where they combine with the hydroxyl ions formed by the dissociation of water to form caustic. The principal advantages of a process carried out in a three-compartment cell lies in the fact that oxidation of the gaseous hydrogen is carried out more readily in the absence of an anolyte solution in the anode chamber. Furthermore, the ratio of sodium to hydrogen ions at the membrane dividing the center chamber and the cathode chamber is very high resulting in preferential transport of the sodium ions to the cathode chamber for the production of caustic.

EXAMPLE 1

A three compartment cell was constructed having an anode housing of tantalum and a cathode housing of stainless steel separated by a buffer compartment frame fabricated of Kynar (tradename of (polyvinyledenefluoride). A 10 mil, unsupported membrane of the type having sulfonate functional groups sold by DuPont under its trade designation Nafion 117 was used as the anode membrane and a 10 mil 1500 EW (Nafion 315) membrane as the cathode membrane. Hydrogen gas at a flow rate of 20 to 100 $cm^3$ per minute was introduced into the anode chamber and an aqueous solution of sodium sulfate was introduced into the center solution and the cell operated to current density of 20 amps/$dm^2$, at 90° C. with center compartment pressurizations ranging from 14 to 24 psi. The operational results of the cell are as follows:

| | #1 | #2 | #3 |
|---|---|---|---|
| Center Feed | 411 | 395 | 401 |
| $Na_2SO_4$ gm/l | | | |
| Center Product | | | |
| $H_2SO_4$ wt % | 7.1 | 7.3 | 11.1 |
| $H_2SO_4$ g/l | 91.6 | 94.5 | 145 |
| $Na_2SO_4$ g/l | 381 | 381 | 352 |
| Catholyte Product | | | |
| NaOH wt % | 11.7 | 12.0 | 12.0 |
| Temp °C. | 90 | 90 | 90 |
| Current Density | | | |
| A/$dm^2$ | 20 | 20 | 20 |
| Cell Voltage | 1.96 | 1.89 | 1.97 |
| Center Pressure psi | 22–24 | 14–18 | 14–16 |
| Anodic Efficiency % | 82 | 77 | 60 |
| Cathodic Efficiency % | 81 | 84 | 80 |
| Power Consumption KWH/mtNaOh | 1620 | 1510 | 1650 |

As may be readily observed from this example cell cathodic current efficiencies in the range of 80–84% were obtained in a hydrogen depolarized configuration with the coproduction of 7 weight percent or more of sulfuric acid and 11 and 12 weight percent of sodium hydroxide at voltages below 2 volts for current densities of approximately 200 ASF (20 A/dm$^2$). The cathodic current efficiencies ran in the 80% range, the anodic efficiencies as high as 80% with a power consumption per metric ton of sodium hydroxide being less than that of the theoretical value required for production of sodium hydroxide by the electrolysis of brine.

In summary, the electrolysis process for sodium salts to co-produce an acid of the salt and caustic utilizes a hydrogen depolarization of an anode as part of the process results in a highly efficient, low cost process for the production of caustic as well as co-production of an acid of the particular salt used as the feedstock.

EXAMPLE 2

A similar cell as that described in Example 1 was operated at a current density of 30 amp/dm$^2$ with all other conditions being the same. Cathodic current efficiencies of 80–82% were obtained with the co-production of 7–7.3 weight percent of sulfuric acid and 11–12 weight percent of sodium hydroxide.

It can be seen from the aforesaid data that by operating the process with the hydrogen depolarized anode substantially results in reductions in the cell voltage and hence in the overall power required for the production of a metric ton of sodium hydroxide is readily achieved.

While the instant invention has been shown in connection with preferred embodiments thereof, the invention is by no means limited thereto, since other modifications of the instrumentalities employed and of the steps of the process carried out, may be made and fall within the scope of the invention. It is contemplated by the appended claims to cover any such modifications that fall within the true scope and spirit of this invention.

What we claim is new and deserving of protection under U.S. Letters Patent is as follows:

1. A process for producing a caustic and an acid of an alkali metal salt comprising:

introducing an anolyte of an alkali metal salt solution into an anolyte chamber, introducing hydrogen gas into the anolyte chamber, causing the anolyte and the hydrogen gas to disassociate into alkali anions, alkali cations and hydrogen ions through the agency of an anode electrode thereby producing an acid, introducing a catholyte into a cathode chamber, disassociating the catholyte into hydrogen and hydroxyl ions through the agency of a cathode electrode, transporting the alkali cations through a perm-selective membrane which is in intimate contact with one or more of the electrodes, to the cathode chamber, thereby producing an alkali metal hydroxide.

2. The process according to claim 1 wherein the electrode in intimate contact with said membrane is bonded thereto.

3. The process according to claim 1 wherein the aqueous alkali metal salt solution is a sodium sulfate solution to produce sulfuric acid and caustic as co-products.

4. The process according to claim 1 wherein the aqueous sodium salt solution is aqueous sodium sulfate.

5. The process according to claim 1 wherein said membrane separating said electrodes comprise a pair of spaced permselective membranes and the aqueous solution is introduced into the space between the membranes, and hydrogen is oxidized on the side of one membrane away from said space to form acid in the space between the membranes and caustic at the cathode.

6. The process according to claim 5 wherein an aqueous solution of sodium sulfate is introduced into the space between the membranes and sulfuric acid is produced in the space and caustic at the cathode.

7. The process according to claim 6 wherein at least one of the electrodes is in intimate contact with one of the membrane surfaces away from the space between the membranes.

8. The process accoridng to claim 6 wherein both electrodes are in intimate contact with the membranes on the membrane surface away from the space between the membranes.

9. A process for producing caustic which comprises electrolyzing an aqueous alkali metal salt in a three compartment cell having an anode and a cathode separated by two permselective membranes, at least one electrode in intimate contact with one of the membranes, introducing an aqueous alkali metal salt solution into the compartment formed between the membranes, oxidizing gaseous hydrogen to form hydrogen ions at the anode electrode whereby the hydrogen ions from the anode are transported across one membrane into the compartment between the membranes to form an acid of the alkali metal salt, forming caustic and gaseous hydrogen at the cathode.

10. The process according to claim 9 wherein at least one of said electrodes is in intimate contact with a permselective membrane.

11. The process according to claim 9 wherein sodium sulfate is introduced into the compartment between the membranes to form sulfuric acid in the compartment and caustic at the cathode electrode.

12. A process for producing caustic and an acid of an alkali metal salt which comprises electrolyzing an aqueous solution of an alkali metal salt and water between anode and cathode electrodes separated by perm-selective membrane means, wherein at least one of the electrodes is in intimate contact with the membrane, oxidizing gaseous hydrogen at the anode to produce acid from the hydrogen ions and the anions of the aqueous alkali metal salt solution and caustic from the alkali metal ions and hydroxyl ions formed at the cathode.

13. The process according to claim 12 wherein an aqueous sodium sulfate solution is electrolyzed to form sulfuric acid and caustic.

* * * * *